United States Patent [19]

Watanabe et al.

[11] 4,133,083

[45] Jan. 9, 1979

[54] LOCK SLIDER FOR SLIDE FASTENERS

[75] Inventors: Koichi Watanabe, Kurobe; Ichiro Terasaki, Uozu, both of Japan

[73] Assignee: Yoshida Kogyo K.K., Tokyo, Japan

[21] Appl. No.: 882,920

[22] Filed: Mar. 2, 1978

[30] Foreign Application Priority Data

Mar. 14, 1977 [JP] Japan ..... 52/30531[U]

[51] Int. Cl.[2] ..... A44B 19/30

[52] U.S. Cl. ..... 24/205.14 A

[58] Field of Search ..... 24/205.14 A, 205.14 R

[56] References Cited

U.S. PATENT DOCUMENTS

| | | | |
|---|---|---|---|
| 2,193,080 | 3/1940 | Soave | 24/205.14 R |
| 2,968,078 | 1/1961 | Huelster | 24/205.14 A |
| 3,789,466 | 2/1974 | Watanabe | 24/205.14 A |

*Primary Examiner*—Bernard A. Gelak

*Attorney, Agent, or Firm*—Bucknam and Archer

[57] ABSTRACT

A pull tab pivotally connected to a slider body is formed integral with a pair of locking cams which, when the pull tab is turned to a recumbent position on the slider body, intrude into the guide channel therein for pressing at least one fastener element into a depression formed in the inside surface of the bottom wing of the slider body and hence for locking the slider against movement. The depression is bounded at its front end by a pair of forwardly converging walls each formed at right angles with the plane of the slider body bottom wing and by a pair of rearwardly converging walls disposed between the forwardly converging walls and each inclined forwardly with respect to the plane of the slider body bottom wing.

2 Claims, 7 Drawing Figures

LOCK SLIDER FOR SLIDE FASTENERS

BACKGROUND OF THE INVENTION

1. Field of the Invention

This invention relates to slide fasteners and, in particular, to improvements in what may be termed a semi-automatic lock slider which can be locked against movement in a desired position on rows of interlocking fastener elements of the discrete type by turning a pull tab to a predetermined recumbent position on the slider body.

2. Description of the Prior Art

According to a lock slider of the type under consideration, at least one fastener element within the slider body is cammed into a depression formed in the inside surface of the bottom wing or plate member of the slider body when a pull tab is manually turned to a recumbent position thereon. The slider is intended to stay locked on the rows of fastener elements as long as the pull tab is maintained in the recumbent position.

The depression in the bottom wing of the slider body has conventionally been of such shape, however, that the fastener element engaged therein is comparatively easy to be disengaged therefrom as the pair of fastener stringers are subjected to a pull tending to separate them away from each other, even if the pull tab remains in the recumbent position. The conventional lock slider is thus likely to be unlocked accidentally as the successive fastener elements move into and out of the depression with the continued exertion of such a pull on the fastener stringers.

SUMMARY OF THE INVENTION

It is an object of this invention to provide an improved lock slider of the type specified which can be held positively locked against movement on a pair of fastener stringers even when they are pulled away from each other.

According to the improved lock slider of the invention, the depression in the inside surface of the bottom wing of the slider body is bounded at its front end by a pair of forwardly converging walls and a pair of rearwardly converging walls disposed between, or at the vertex of, the forwardly converging walls and each inclined forwardly with respect to the plane of the bottom wing.

Thus, as one of the fastener elements of paired stringers used with the lock slider is cammed into the above depression in the inside surface of the slider body bottom wing upon locking of the slider, this element is caught between one of the rearwardly converging walls and the corresponding one of the usual guide flanges formed along the marginal edges of the bottom wing. Further, as the wedge-shaped interlock portion on the head of the fastener element makes close contact with one of the rearwardly converging walls which are each inclined forwardly, the fastener element can be held stably engaged in the depression to prevent the accidental unlocking of the slider even when the pair of fastener stringers are pulled away from each other.

The above and other objects, features and advantages of this invention and the manner of attaining them will become more readily apparent, and the invention itself will best be understood, from the following description of a preferred embodiment taken in connection with the accompanying drawings.

DETAILED DESCRIPTION

Figure 1:
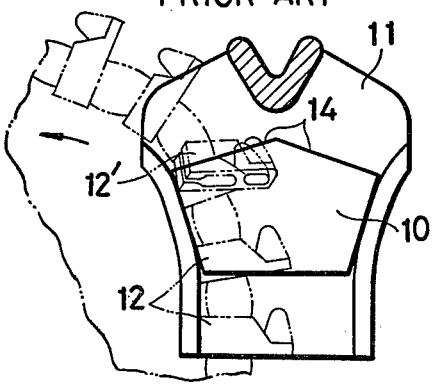
FIG. 1 PRIOR ART
FIG. 1 is a plan view showing the bottom wing or plate member of a prior art lock slider, with its top wing cut away, in order to explain the way the prior art lock slider is unlocked accidentally.
Figure 2:
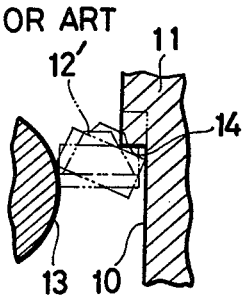
FIG. 2 PRIOR ART
FIG. 2 is a fragmentary sectional view of the prior art lock slider of FIG. 1, the view being also explanatory of the way the slider is unlocked accidentally.

A consideration of FIG. 1 and 2 of the above drawings will make clear the above noted problem attendant upon the prior art. The slider body of the conventional lock slider has a depression 10 formed in the inside surface of its bottom wing 11 for partly receiving fastener elements 12 as they are pressed by a pair of locking cams 13 formed integral with a pull tab (not shown in FIGS. 1 and 2). This depression 10 is bounded in part by a pair of forwardly converging walls 14 which extend at right angles with the plane of the slider body bottom wing 11.

Thus, as the pair of fastener stringers (one shown by broken lines in FIG. 1) are pulled away from each other while the conventional lock slider is locked thereon, the particular fastener element 12' which has been pressed into the depression 10 by one of the locking cams 13 is first turned forwardly to some extent over one of the converging walls 14 of the depression, as depicted in FIG. 2. With the continued exertion of a lateral pull on the fastener stringers, the fastener element 12' slides up, with its body portion foremost, over the wall 14 of the depression 10, as will be seen from FIG. 1. The conventional lock slider is thus unlocked undesiredly as the successive fastener elements 12 move into and out of the depression.

Figure 3:
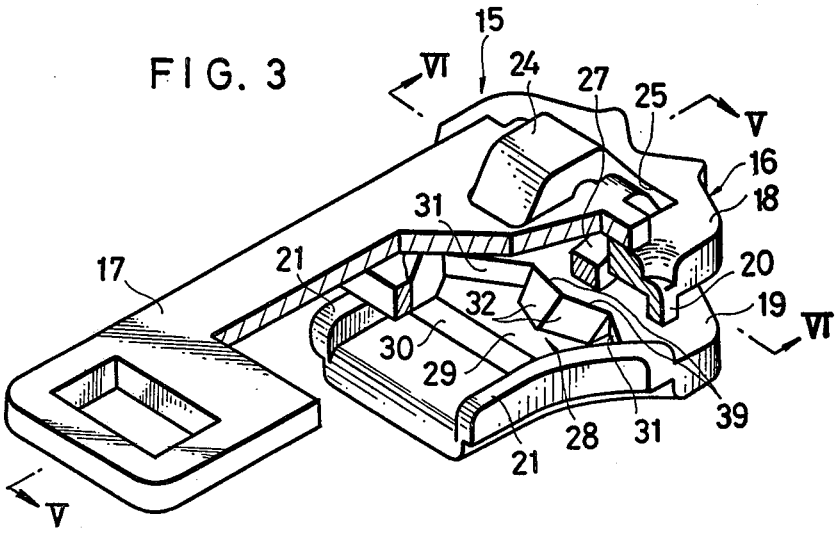
FIG. 3 is a perspective view, with parts cut away to clearly reveal other parts, of a preferred form of the lock slider in accordance with this invention.

FIGS. 3 through 6 illustrate an improved lock slider of this invention, generally designated 15, that thoroughly eliminates the above explained drawback of the prior art. With particular reference to FIG. 3, the lock slider 15 broadly comprises a slider body 16 and a pull tab 17, the latter being pivotally connected at one end to the former.

Figure 4:
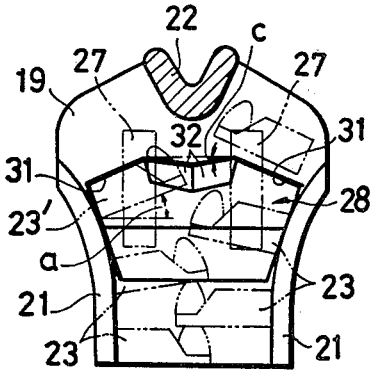
FIG. 4 is a plan view showing the bottom wing of the lock slider of FIG. 3, with its top wing cut away, the view also showing rows of interlocking fastener elements in the guide channel of the slider.
Figure 5:
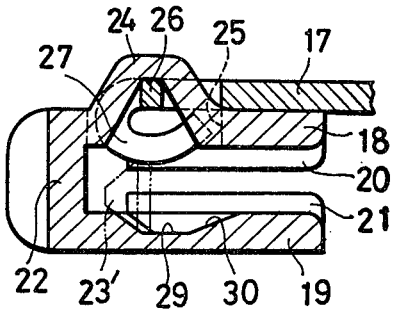
FIG. 5 is a sectional view taken along the line V—V of FIG. 3 and showing the slider locked against movement.
Figure 6:
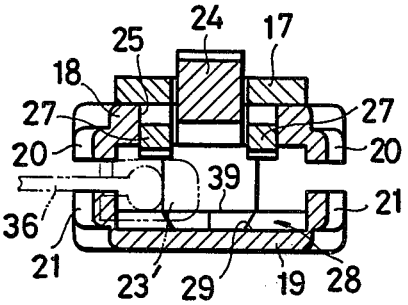
FIG. 6 is a sectional view taken along the line VI—VI of FIG. 3 and also showing the slider locked against movement.

As will be seen also from FIGS. 4 through 6, the slider body 16 comprises top and bottom wings or plate members 18 and 19 having guide flanges 20 and 21 along marginal edges thereof and which are connected at their flared front ends by an integral neck 22 so as to provide therebetween a Y-shaped guide channel for rows of interlocking fastener elements 23. The fastener elements for use with the lock slider 15 of this invention are of the usual discrete type, as will be later described in more detail with reference to FIG. 7. The top wing 18 of the slider body 16 has an integral lug 24 located approximately centrally thereon and has further formed therein a pair of openings 25 located on both sides of the lug.

The pull tab 17 has a pivot pin portion 26 at one of its ends which is somewhat loosely engaged with the lug 24 on the slider body top wing 18, so that the pull tab is pivotable with respect to the slider body 16. Also provided at said one end of the pull tab 17 are a pair of locking cams 27 which are formed by folding or rolling a pair of parallel spaced arms projecting from the pull tab end, as best shown in FIG. 5.

The locking cams 27 intrude into the guide channel in the slider body 16 through the respective openings 25 in its top wing 18 for pressing the fastener elements 23 against the slider body bottom wing 19, and hence for locking the slider 15 against movement, when the pull tab 17 is manually turned to a predetermined recumbent position on the slider body. FIGS. 3, 5 and 6 show the pull tab 17 in such a recumbent position, in which the pull tab extends rearwardly of the slider body 16 and lies in a plane parallel to or substantially parallel to the planes of the slider body wings 18 and 19. The lock slider 15 can of course be unlocked simply as the pull tab 17 pivots up away from the slider body 16 in order to move the slider along the rows of fastener elements 23 for engaging or disengaging same.

The reference numeral 28 generally designates a depression formed in the inside surface of the slider body bottom wing 19 for partly receiving the fastener elements 23 as they are pressed by the locking cams 27. This depression 28 has a flat bottom 29 lying in the plane of the slider body bottom wing 19. The depression 28 is bounded at its rear end by a wall 30 sloping rearwardly with respect to the plane of the slider body bottom wing and at its sides by portions of the guide flanges 21.

At its front end the depression 28 is bounded by a pair of walls 31 converging forwardly or disposed substantially in the shape of an inverted V as seen in a plan view as in FIG. 4 and by another pair of walls 32 converging rearwardly or disposed in the shape of a V. The rearwardly converging wall pair 32 is located between, or at the vertex of, the forwardly converging wall pair 31. The forwardly converging walls 31 each extend at right angles with the plane of the slider body bottom wing 19, whereas the rearwardly converging walls 32 are each inclined forwardly with respect to the plane of the slider body bottom wing.

Figure 7:
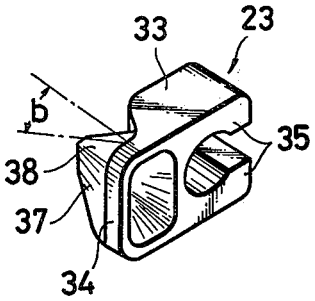
FIG. 7 is an enlarged perspective view of one of the fastener elements suitable for use with the lock slider of this invention.

FIG. 7 is an enlarged representation of one of the fastener elements 23 suitable for use with the lock slider 15 of this invention. The fastener element 23 has a body portion 33 and a head 34 fixed to one end of and integral with the body portion. The body portion 33 is recessed to provide a pair of jaws 35 for gripping the beaded or reinforced edge of a stringer tape indicated at 36 in FIG. 6. The head 34 is formed to include a substantially wedge-shaped male and female interlock portion 37.

With reference to both FIGS. 4 and 7 in particular, the angle of inclination of the rearwardly converging walls 32 with respect to the plane of the slider body bottom wing 19 is determined in consideration of the angle a between the particular fastener element 23' pressed by one of the locking cams 27 and a plane at right angles with the longitudinal axis of the lock slider 15 and of the angle b between a surface 38 of the interlock portion 37 of the fastener element and the plane of the slide fastener. Each of the rearwardly converging walls 32 is thus adapted to make neat contact with the wedge-shaped interlock portion 37 of the fastener element being pressed by the corresponding one of the locking cams 27. Each wall 32 is also intended to make contact with the head 34 of the fastener element.

It is therefore apparent, from FIG. 4 in particular, that the fastener element 23' pressed downwardly by one of the locking cams 27 is caught between the corresponding one of the rearwardly converging walls 32 and the corresponding one of the guide flanges 21 on the slider body bottom wing 19. Preferably, the angle c between the top edge 39 of each of the rearwardly converging walls 32 and the plane at right angles with the longitudinal axis of the lock slider 15 is approximately the same as, or at least about one half, the aforesaid angle a between the fastener element 23' and the plane at right angles with the longitudinal axis of the slider.

The improved lock slider 15 of this invention being constructed as in the foregoing, the paired locking cams 27 on the pull tab 17 intrude into the guide channel in the slider body 16 when the pull tab is turned to the recumbent position thereon. FIGS. 4 through 6 illustrate the fastener element 23' resultantly pressed downwardly by one of the locking cams 27 into the depression 28 in the inside surface of the slider body bottom wing 19. The lock slider 15 is now locked against movement in either direction along the rows of ingerlocking fastener elements 23.

As mentioned, the fastener element 23' cammed as above into the depression 28 is caught between one of the rearwardly converging walls 32 and the opposed one of the guide flanges 21, with its interlock portion 37 in close contact with the wall 32 and with its head 34 also in partial contact therewith. The fastener element 23' is not to be easily turned about the top edge 39 of the wall 32, or to slide out of the depression 28, even when the fastener stringers are forcibly pulled away from each other. The improved lock slider 15 can therefore be positively locked against accidental or undesired movement.

While only one embodiment of the present invention has been shown and described in detail, it will be easy for those skilled in the art to devise many modifications and variations of the lock slider on the basis of this disclosure without departing from the spirit and scope of the invention as expressed in the following claims.

What is claimed is:

1. A lock slider which can be locked against movement in a desired position on rows of interlocking fastener elements, comprising a slider body having top and bottom wings connected at their front ends so as to provide therebetween a guide channel for the fastener elements, the top wing of the slider body having at least one opening formed therein, a pull tab pivotally connected at one end to the top wing of the slider body, and locking means on said one end of the pull tab capable of intruding into the guide channel through the opening in the top wing of the slider body for pressing the fastener elements therein against the bottom wing of the slider body and hence for locking the slider against movement when the pull tab is turned to a recumbent position on the slider body, the bottom wing of the slider body having formed in its inside surface a depression for partly receiving the fastener elements pressed by the locking means, the depression being bounded at its front end by a pair of forwardly converging walls and a pair of rearwardly converging walls disposed between the forwardly converging walls and each inclined forwardly with respect to the plane of the bottom wing of the slider body.

2. A lock slider according to claim 1, wherein the depression is bounded at its sides by portions of a pair of guide flanges formed along the marginal edges of the bottom wing of the slider body.

* * * * *